US008463420B2

(12) United States Patent
Tokura

(10) Patent No.: US 8,463,420 B2
(45) Date of Patent: Jun. 11, 2013

(54) SEWING MACHINE AND NON-TRANSITORY COMPUTER-READABLE MEDIUM STORING SEWING MACHINE CONTROL PROGRAM

(75) Inventor: Masashi Tokura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 205 days.

(21) Appl. No.: 13/041,943

(22) Filed: Mar. 7, 2011

(65) Prior Publication Data

US 2011/0226170 A1 Sep. 22, 2011

(30) Foreign Application Priority Data

Mar. 19, 2010 (JP) ..... 2010-064437

(51) Int. Cl.
*G06F 19/00* (2011.01)

(52) U.S. Cl.
USPC ..... 700/137; 112/475.19

(58) Field of Classification Search
USPC ..... 112/445, 153, 306, 456, 121.11, 112/121.12, 475.19; 700/138, 136, 137
See application file for complete search history.

(56) References Cited

U.S. PATENT DOCUMENTS

| | | | | |
|---|---|---|---|---|
| 4,998,489 | A | 3/1991 | Hisatake et al. | |
| 5,042,410 | A | 8/1991 | Nakashima | |
| 5,195,451 | A * | 3/1993 | Nakashima | 112/102.5 |
| 5,323,722 | A | 6/1994 | Goto et al. | |
| 5,537,946 | A | 7/1996 | Sadeh et al. | |
| 5,553,559 | A | 9/1996 | Inoue et al. | |
| 5,855,176 | A | 1/1999 | Takenoya et al. | |
| 5,865,133 | A | 2/1999 | Herbach et al. | |
| 5,911,182 | A | 6/1999 | Uyama et al. | |
| 6,000,350 | A | 12/1999 | Koike et al. | |
| 6,158,366 | A | 12/2000 | Codos | |
| 6,167,822 | B1 | 1/2001 | Miyasako et al. | |
| 6,407,745 | B1 | 6/2002 | Yamada et al. | |
| 6,715,435 | B1 * | 4/2004 | Wieczorek et al. | 112/475.03 |
| 7,155,302 | B2 | 12/2006 | Muto et al. | |
| 7,702,415 | B2 | 4/2010 | Roos | |
| 7,848,842 | B2 | 12/2010 | Suzuki et al. | |

(Continued)

FOREIGN PATENT DOCUMENTS

| | | |
|---|---|---|
| EP | 1 777 331 A1 | 4/2007 |
| JP | A-3-254782 | 11/1991 |

(Continued)

OTHER PUBLICATIONS

European Search Report issued in Application No. 11158244.1; Dated Aug. 2, 2011.

(Continued)

*Primary Examiner* — Danny Worrell
(74) *Attorney, Agent, or Firm* — Oliff & Berridge, PLC

(57) ABSTRACT

A sewing machine includes a creating portion that creates a projection image being an image that includes a characteristic point and that is to be projected onto a sewing object, a projecting portion that projects onto the sewing object the projection image created by the creating portion, an image capture portion that is mounted in a position being different from a position of the projecting portion and that creates a captured image by image capture of the characteristic point projected by the projecting portion, and a computing portion that computes a thickness of the sewing object based on the projection image created by the creating portion and the captured image created by the image capture portion.

4 Claims, 10 Drawing Sheets

U.S. PATENT DOCUMENTS

| | | | | |
|---|---|---|---|---|
| 7,854,209 | B2 * | 12/2010 | Yamasaki | 112/444 |
| 2006/0096510 | A1 | 5/2006 | Kuki et al. | |
| 2007/0221107 | A1 | 9/2007 | Kato et al. | |
| 2009/0188413 | A1 | 7/2009 | Hirata et al. | |
| 2009/0188415 | A1 | 7/2009 | Tokura | |
| 2009/0217850 | A1 | 9/2009 | Tokura | |
| 2011/0146553 | A1 | 6/2011 | Wilhelmsson et al. | |

FOREIGN PATENT DOCUMENTS

| | | |
|---|---|---|
| JP | A-3-254783 | 11/1991 |
| JP | A-5-269285 | 10/1993 |
| JP | A-6-241748 | 9/1994 |
| JP | A-9-81779 | 3/1997 |
| JP | A-2000-55636 | 2/2000 |
| JP | A-2001-229388 | 8/2001 |
| JP | A-2001-330413 | 11/2001 |
| JP | A-2004-28728 | 1/2004 |
| JP | A-2004-144644 | 5/2004 |
| JP | A-2004-151883 | 5/2004 |
| JP | A-2005-115420 | 4/2005 |
| JP | A-2008-188148 | 8/2008 |
| JP | A-2009-172123 | 8/2009 |
| JP | A-2009-174981 | 8/2009 |
| JP | A-2009-201704 | 9/2009 |

OTHER PUBLICATIONS

U.S. Appl. No. 13/042,008, filed Mar. 7, 2011, by Tokura.
Feb. 12, 2013 Office Action issued in U.S. Appl. No. 13/042,008.

* cited by examiner

SEWING MACHINE AND NON-TRANSITORY COMPUTER-READABLE MEDIUM STORING SEWING MACHINE CONTROL PROGRAM

CROSS-REFERENCE TO RELATED APPLICATION

This application claims priority to Japanese Patent Application No. 2010-064437, filed Mar. 19, 2010, the content of which is hereby incorporated herein by reference.

BACKGROUND

The present disclosure relates to a sewing machine that includes a projection portion and an image capture portion and to a non-transitory computer-readable medium that stores a sewing machine control program.

A sewing machine is known that is provided with a function that detects the thickness of a work cloth that is an object of sewing. In this sort of sewing machine, the thickness of the work cloth is detected by an angle sensor that is provided on a member that presses the work cloth, for example. Then, a point mark at a position that corresponds to the cloth thickness is illuminated by a marking light. A cloth stage detector detects the thickness of the work cloth based on the position of a beam of light that is projected onto the work cloth by a light-emitting portion and reflected by the work cloth.

SUMMARY

In a case where the thickness of the work cloth is detected using the angle sensor, the thickness may not be detected in a state where the work cloth is not being pressed. For example, in a case where the work cloth tends to contract and in a case where the work cloth is a quilted material that is filled with cotton batting, the thickness may not be properly detected by the known sewing machine in a state where the work cloth is not being pressed. In a case where the thickness is detected based on the position of a beam of light that is reflected by the work cloth, an area within which the thickness can be detected may be extremely narrow. Therefore, in order to detect the thickness at the desired position, a user may need to perform a complicated operation of positioning the portion of the work cloth where the thickness is to be detected in the small area onto which the light will be shone.

Various exemplary embodiments of the broad principles derived herein provide a sewing machine and a non-transitory computer-readable medium storing a sewing machine control program that enables detecting, by a simple operation, the thickness of a sewing object that is not being pressed.

Exemplary embodiments provide the sewing machine that includes a creating portion that creates a projection image being an image that includes a characteristic point and that is to be projected onto a sewing object, and a projecting portion that projects onto the sewing object the projection image created by the creating portion. The sewing machine also includes an image capture portion that is mounted in a position being different from a position of the projecting portion and that creates a captured image by image capture of the characteristic point projected by the projecting portion, and a computing portion that computes a thickness of the sewing object based on the projection image created by the creating portion and the captured image created by the image capture portion.

Exemplary embodiments also provide a non-transitory computer-readable medium storing a control program executable on a sewing machine. The program includes instructions that cause a computer of the sewing machine to perform the steps of creating a projection image being an image that includes a characteristic point and that is to be projected onto a sewing object, acquiring a captured image created by image capture of the characteristic point projected on the sewing object, and computing a thickness of the sewing object based on the projection image and the captured image.

BRIEF DESCRIPTION OF THE DRAWINGS

Exemplary embodiments will be described below in detail with reference to the accompanying drawings in which.

DETAILED DESCRIPTION

Hereinafter, a sewing machine 1 according to first and second embodiments of the present disclosure will be explained in order with reference to the drawings. The drawings are used for explaining technical features that can be used in the present disclosure, and the device configuration, the flowcharts of various types of processing, and the like that are described are simply explanatory examples that does not limit the present disclosure to only the configuration, the flowcharts, and the like.

Figure 1:
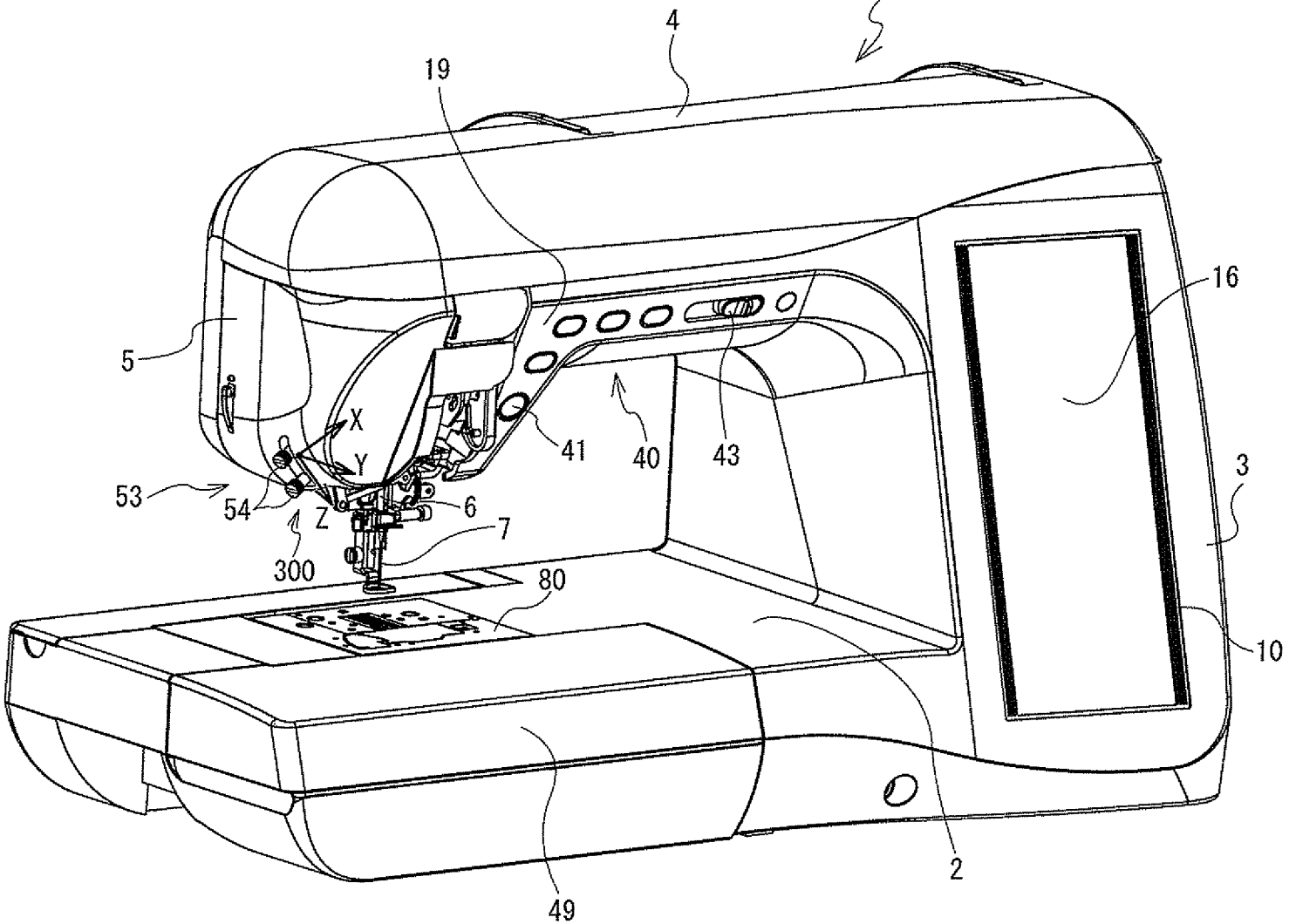
FIG. 1 is an oblique view of a sewing machine 1 in a case where a side table 49 is attached to the left end of a bed 2.
Figure 2:
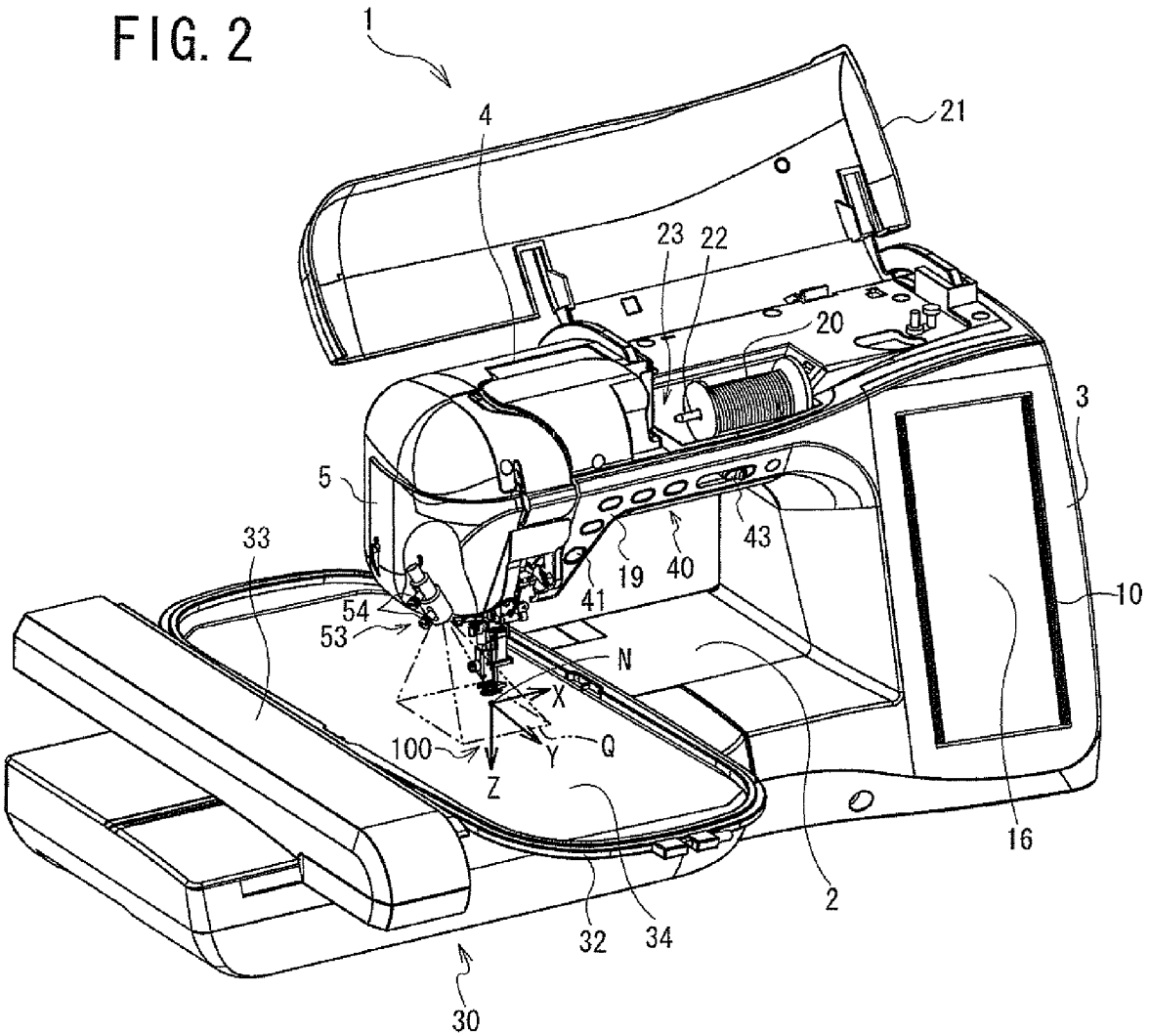
FIG. 2 is an oblique view of the sewing machine 1 in a case where an embroidery unit 30 is attached to the left end of the bed 2.

A physical configuration and an electrical configuration of the sewing machine 1 according to the first and second embodiments will be explained with reference to FIGS. 1 to 5. In FIGS. 1 and 2, a direction of an arrow X, an opposite direction of the arrow X, a direction of an arrow Y, and an opposite direction of the arrow Y are respectively referred to as a right direction, a left direction, a front direction, and a rear direction. As shown in FIGS. 1 and 2, the sewing machine 1 includes a bed 2, a pillar 3, and an arm 4. The long dimension of the bed 2 is the left-right direction. The pillar 3 extends upward from the right end of the bed 2. The arm 4 extends to the left from the upper end of the pillar 3. A head 5 is provided in the left end portion of the arm 4. A liquid crystal display (LCD) 10 is provided on a front surface of the pillar 3. A touch panel 16 is provided on a surface of the LCD 10. Input keys, which are used to input a sewing pattern and a sewing condition, and the like may be, for example, displayed on the LCD 10. A user may select a condition, such as a sewing pattern, a sewing condition, or the like, by touching a position of the touch panel 16 that corresponds to a position of an image that is displayed on the LCD 10 using the user's finger or a dedicated stylus pen. Hereinafter, an operation of touching the touch panel 16 is referred to as a "panel operation".

A feed dog front-and-rear moving mechanism (not shown in the drawings), a feed dog up-and-down moving mechanism (not shown in the drawings), a pulse motor 78 (refer to FIG. 5), and a shuttle (not shown in the drawings) are accommodated within the bed 2. The feed dog front-and-rear moving mechanism and the feed dog up-and-down moving mechanism drive the feed dog (not shown in the drawings). The pulse motor 78 adjusts a feed amount of a sewing object (not shown in the drawings) by the feed dog. The shuttle may accommodate a bobbin (not shown in the drawings) on which a lower thread (not shown in the drawings) is wound. One of a side table 49 shown in FIG. 1 and an embroidery unit 30 shown in FIG. 2 may be attached to the left end of the bed 2. When the embroidery unit 30 is attached to the left end of the bed 2, as shown in FIG. 2, the embroidery unit 30 is electrically connected to the sewing machine 1. The embroidery unit 30 will be described in more detail below.

Figure 3:
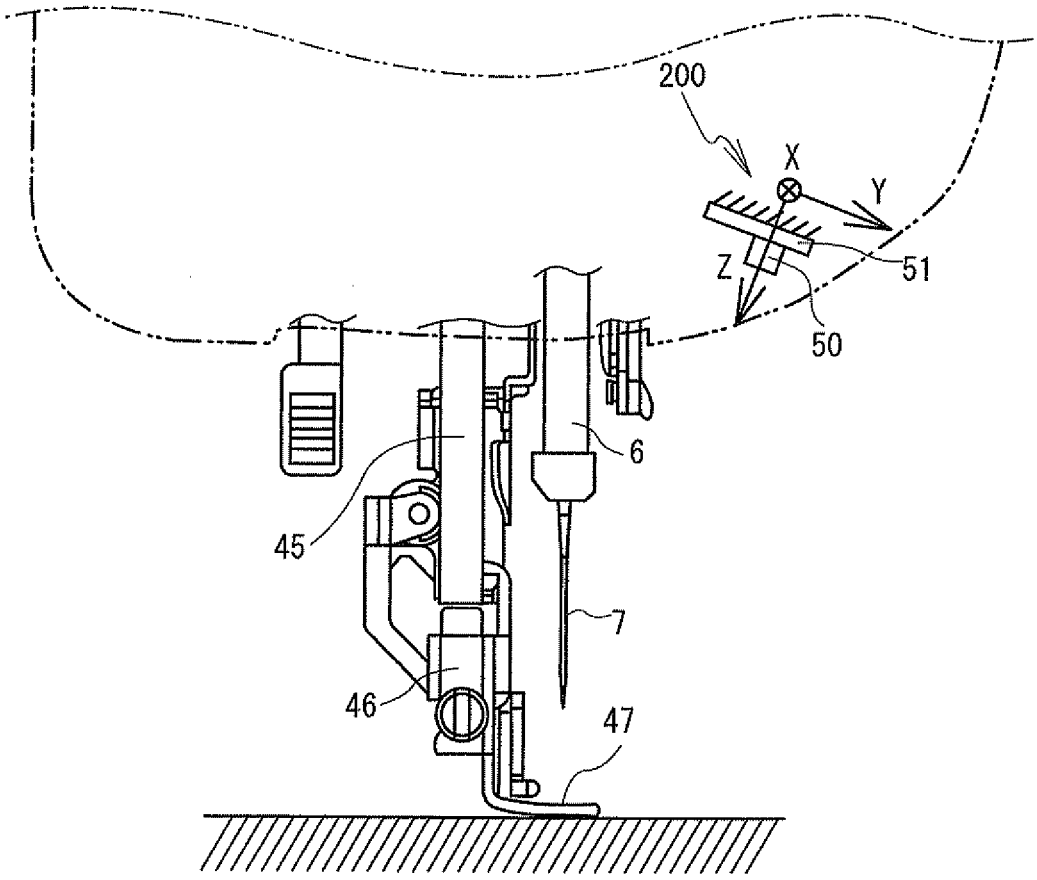
FIG. 3 is a diagram of an area around a needle 7 as seen from the left side of the sewing machine 1.

A sewing machine motor 79 (refer to FIG. 5), the drive shaft (not shown in the drawings), a needle bar 6 (refer to FIG. 3), a needle bar up-down moving mechanism (not shown in the drawings), and a needle bar swinging mechanism (not shown in the drawings) are accommodated within the pillar 3 and the arm 4. As shown in FIG. 3, a needle 7 may be attached to the lower end of the needle bar 6. The needle bar up-down moving mechanism moves the needle bar 6 up and down using the sewing machine motor 79 as a drive source. The needle bar swinging mechanism moves the needle bar 6 in the left-right direction using a pulse motor 77 (refer to FIG. 5) as a drive source. As shown in FIG. 3, a presser bar 45, which extends in the up-down direction, is provided at the rear of the needle bar 6. A presser holder 46 is fixed to the lower end of the presser bar 45. A presser foot 47, which presses a sewing object (not shown in the drawings), may be attached to the presser holder 46.

A top cover 21 is provided in the longitudinal direction of the arm 4. The top cover 21 is axially supported at the rear upper edge of the arm 4 such that the top cover 21 may be opened and closed around the left-right directional shaft. A thread spool housing 23 is provided close to the middle of the top of the arm 4 under the top cover 21. The thread spool housing 23 is a recessed portion for accommodating a thread spool 20 that supplies a thread to the sewing machine 1. A spool pin 22, which projects toward the head 5, is provided on an inner face of the thread spool housing 23 on the pillar 3 side. The thread spool 20 may be attached to the spool pin 22 when the spool pin 22 is inserted through the insertion hole (not shown in the drawings) that is formed in the thread spool 20. Although not shown in the drawings, the thread of the thread spool 20 may be supplied as an upper thread to the needle 7 (refer to FIG. 1) that is attached to the needle bar 6 through a plurality of thread guide portions provided on the head 5. The sewing machine 1 includes, as the thread guide portions, a tensioner, a thread take-up spring, and a thread take-up lever, for example. The tensioner and the thread take-up spring adjust the thread tension of the upper thread. The thread take-up lever is driven reciprocally up and down and pulls the upper thread up.

A pulley (not shown in the drawings) is provided on a right side surface of the sewing machine 1. The pulley is used to manually rotate the drive shaft (not shown in the drawings). The pulley causes the needle bar 6 to be moved up and down. A front cover 19 is provided on a front surface of the head 5 and the arm 4. A group of switches 40 is provided on the front cover 19. The group of switches 40 includes a sewing start/stop switch 41 and a speed controller 43, for example. The sewing start/stop switch 41 is used to issue a command to start or stop sewing. If the sewing start/stop switch 41 is pressed when the sewing machine 1 is stopped, the operation of the sewing machine 1 is started. If the sewing start/stop switch 41 is pressed when the sewing machine 1 is operating, the operation of the sewing machine 1 is stopped. The speed controller 43 is used for controlling the revolution speed of the drive shaft. An image sensor 50 (refer to FIG. 3) is provided inside the front cover 19, in an upper right position as seen from the needle 7.

The image sensor 50 will be explained with reference to FIG. 3. The image sensor 50 is a known CMOS image sensor. The image sensor 50 is mounted in a position where the image sensor 50 can acquire an image of the bed 2 and a needle plate 80 that is provided on the bed 2. In the present embodiment, the image sensor 50 is attached to a support frame 51 that is attached to a frame (not shown in the drawings) of the sewing machine 1. The image sensor 50 captures an image of an image capture area that includes a needle drop position N of the needle 7, and outputs image data that represent electrical signals into which incident light has been converted. The needle drop position N is a position (point) where the needle 7 pierces the sewing object when the needle bar 6 is moved downward by the needle bar up-down moving mechanism (not shown in the drawings). Hereinafter, the outputting by the image sensor 50 of the image data that represent the electrical signals into which the incident light has been converted is referred to as the "creating of an image by the image sensor 50".

As shown in FIGS. 1 and 2, a projector 53 is attached to the left front portion of the head 5. The projector 53 projects an image onto a sewing object 34. The greater part of the projector 53 is contained in the interior of the head 5. A pair of adjusting screws 54 protrude to the outside of the head 5. The adjusting screws 54 are used for adjusting the size and the focal point of the image that is to be projected. The image that is to be projected is hereinafter referred to as the "projection image". The projector 53 projects the projection image in a projection area Q that includes the needle drop position N on the bed 2. In the present embodiment, in order for the thickness of the sewing object to be specified, the projector 53 projects the projection image onto one of a sewing object that is disposed on the bed 2 and the sewing object 34 that is held by an embroidery frame 32. The projector 53 projects the projection image onto the sewing object obliquely from above, so processing is performed in order to correct for the distortion in the projection image, although a detailed explanation will be omitted.

Figure 4:
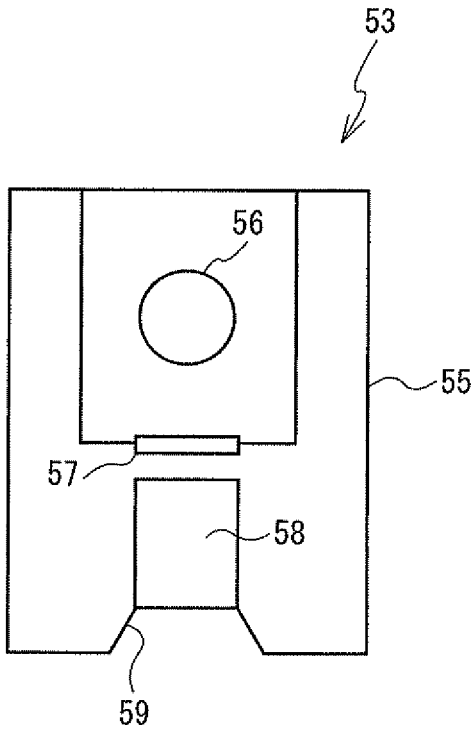
FIG. 4 is a schematic diagram that shows a configuration of a projector 53.

As shown in FIG. 4, the projector 53 includes a housing 55, a light source 56, a liquid crystal panel 57, and an imaging lens 58. In the present embodiment, the housing 55 is formed into a tubular shape. A projection opening 59 is provided in the housing 55. The housing 55 is fixed to the frame of the head 5 in an orientation in which the housing 55 faces downward obliquely toward the rear and the right side, such that the area around the needle drop position N is positioned on the axial line of the housing 55. A metal halide type discharge lamp, for example, can be used as the light source 56. The liquid crystal panel 57 modulates the light from the light source 56 and, based on data that describe the projection image, forms an image light for the image that is projected. The imaging lens 58 causes the image light, which has been formed by the liquid crystal panel 57 and goes through the projection opening 59, to provide the image in the projection area Q (refer to FIG. 2) that includes the needle drop position N, which is the focal position, on the sewing object. The projection area Q is a rectangular area with a length of 80 millimeters in the left-right direction and a length of 60 millimeters in the front-rear direction. In the present embodiment, the projection area Q for the projector 53 and the aforementioned image capture area for the image sensor 50 are set such that the projection area Q and the image capture area are congruent.

The embroidery unit 30 will be explained with reference to FIG. 2. The embroidery unit 30 includes a carriage (not shown in the drawings), a carriage cover 33, a front-rear movement mechanism (not shown in the drawings), a left-right movement mechanism (not shown in the drawings), and the embroidery frame 32. The carriage may detachably support the embroidery frame 32. A groove portion (not shown in the drawings) is provided on the right side of the carriage. The groove portion extends in the longitudinal direction of the carriage. The embroidery frame 32 may be attached to the groove portion. The carriage cover 33 generally has a rectangular parallelepiped shape that is long in the front-rear direction. The carriage cover 33 accommodates the carriage. The front-rear movement mechanism (not shown in the drawings) is provided inside the carriage cover 33. The front-rear movement mechanism moves the carriage, to which the embroidery frame 32 may be attached, in the front-rear direction using a Y axis motor 82 (refer to FIG. 5) as a drive source. The left-right movement mechanism is provided inside a main body of the embroidery unit 30. The left-right movement mechanism moves the carriage, to which the embroidery frame 32 may be attached, the front-rear movement mechanism, and the carriage cover 33 in the left-right direction using an X axis motor 81 (refer to FIG. 5) as a drive source. The embroidery frame 32 is not limited to the size that is shown in FIG. 1, and various sizes of embroidery frames (not shown in the drawings) have been prepared.

Based on an amount of movement that is expressed by coordinates in an embroidery coordinate system, drive commands for the Y axis motor 82 and the X axis motor 81 are output by a CPU 61 (refer to FIG. 5) that will be described below. The embroidery coordinate system is a coordinate system for indicating the amount of movement of the embroidery frame 32 to the X axis motor 81 and the Y axis motor 82. In the embroidery coordinate system, the left-right direction that is the direction of movement of the left-right moving mechanism is the X axis direction, and the front-rear direction that is the direction of movement of the front-rear moving mechanism is the Y axis direction. In the embroidery coordinate system in the present embodiment, in a case where the center of a sewing area of the embroidery frame 32 is directly below the needle 7, the center of the sewing area is defined as an origin position (X, Y, Z)=(0, 0, Z) in the XY plane. The embroidery unit 30 in the present embodiment does not move the embroidery frame 32 in the Z axis direction (the up-down direction of the sewing machine 1). The Z coordinate is therefore determined according to the thickness of a sewing object 34 such as the work cloth. The amount of movement of the embroidery frame 32 is set using the origin position in the XY plane as a reference position.

Figure 5:
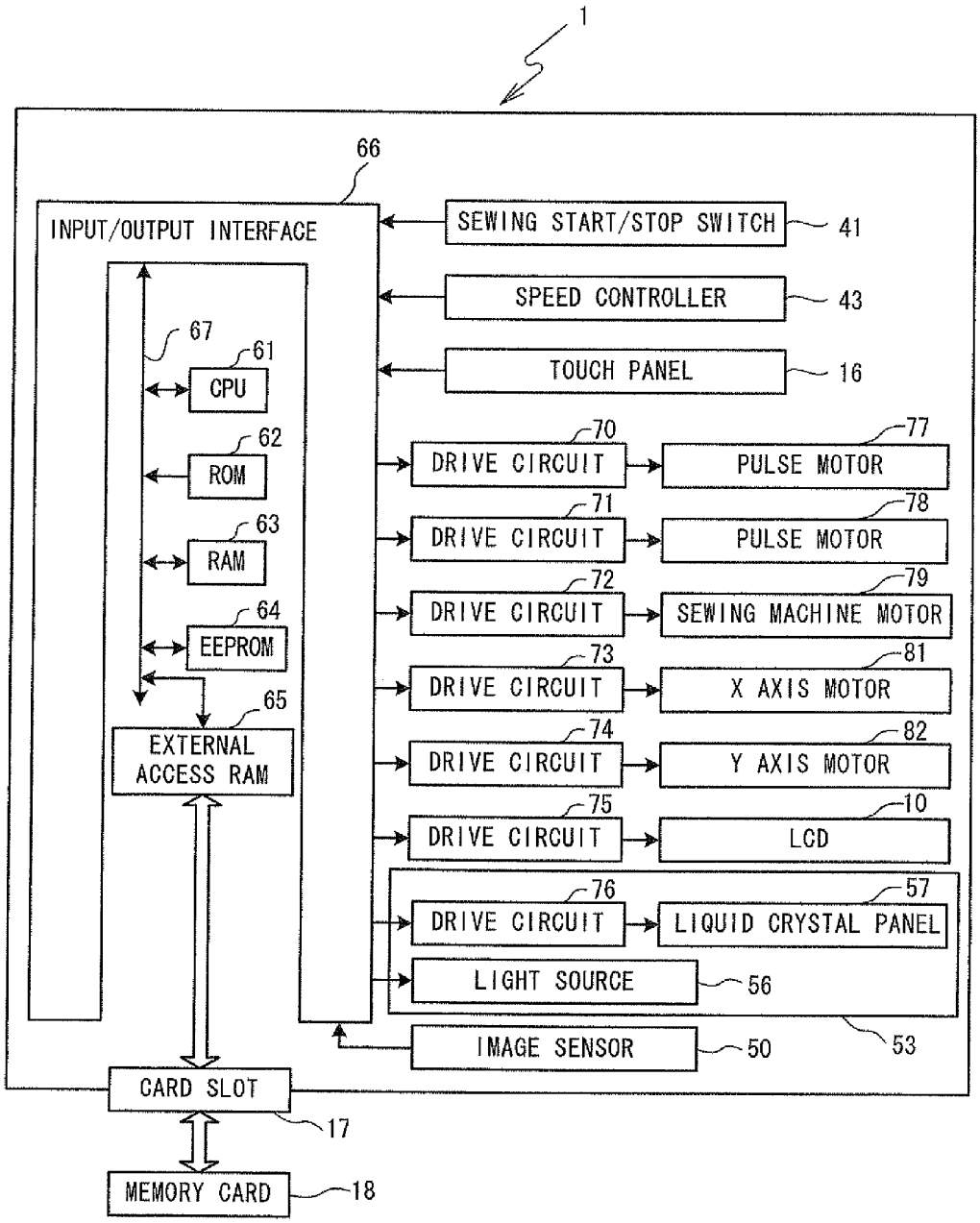
FIG. 5 is a block diagram that shows an electrical configuration of the sewing machine 1.

A main electrical configuration of the sewing machine 1 will be explained with reference to FIG. 5. As shown in FIG. 5, the sewing machine 1 includes the CPU 61, a ROM 62, a RAM 63, an EEPROM 64, an external access RAM 65, and an input/output interface 66, which are connected to one another via a bus 67.

The CPU 61 conducts main control over the sewing machine 1, and performs various types of computation and processing in accordance with programs stored in the ROM 62 and the like. The ROM 62 includes a plurality of storage areas including a program storage area. Programs that are executed by the CPU 61 are stored in the program storage area. The RAM 63 is a storage element that can be read from and written to as desired. The RAM 63 stores, for example, data that is required when the CPU 61 executes a program and computation results that is obtained when the CPU 61 performs computation. The EEPROM 64 is a storage element that can be read from and written to. The EEPROM 64 stores various parameters that are used when various types of programs stored in the program storage area are executed. Storage areas of the EEPROM 64 will be described in detail below. A card slot 17 is connected to the external access RAM 65. The card slot 17 can be connected to a memory card 18. The sewing machine 1 can read and write information from and to the memory card 18 by connecting the card slot 17 and the memory card 18.

The sewing start/stop switch 41, the speed controller 43, the touch panel 16, the image sensor 50, drive circuits 70 to 76, and the light source 56 are electrically connected to the input/output interface 66. The drive circuit 70 drives the pulse motor 77. The pulse motor 77 is a drive source of the needle bar swinging mechanism (not shown in the drawings). The drive circuit 71 drives the pulse motor 78 for adjusting a feed amount. The drive circuit 72 drives the sewing machine motor 79. The sewing machine motor 79 is a drive source of the drive shaft (not shown in the drawings). The drive circuit 73 drives the X axis motor 81. The drive circuit 74 drives the Y axis motor 82. The drive circuit 75 drives the LCD 10. The drive circuit 76 drives the liquid crystal panel 57 of the projector 53. Another element (not shown in the drawings) may be connected to the input/output interface 66 as appropriate.

The storage areas of the EEPROM 64 will be explained. The EEPROM 64 includes a settings storage area, an internal variables storage area, and an external variables storage area, which are not shown in the drawings. Setting values that are used when the sewing machine 1 performs various types of processing are stored in the settings storage area. The setting values that are stored may include, for example, correspondences between the types of embroidery frames and the sewing areas.

Internal variables for the image sensor 50 and the projector 53 are stored in the internal variables storage area. The internal variables for the image sensor 50 are parameters to correct a shift in focal length, a shift in principal point coordinates, and distortion of a captured image due to properties of the image sensor 50. An X-axial focal length, a Y-axial focal length, an X-axial principal point coordinate, a Y-axial principal point coordinate, a first coefficient of distortion, and a second coefficient of distortion are stored as internal variables in the internal variables storage area. The X-axial focal length represents an X-axis directional shift of the focal length of the image sensor 50. The Y-axial focal length represents a Y-axis directional shift of the focal length of the image sensor 50. The X-axial principal point coordinate represents an X-axis directional shift of the principal point of the image sensor 50. The Y-axial principal point coordinate represents a Y-axis directional shift of the principal point of the image sensor 50. The first coefficient of distortion and the second coefficient of distortion represent distortion due to the inclination of a lens of the image sensor 50. The internal variables may be used, for example, in processing that converts the image that the sewing machine 1 has captured into a normalized image and in processing in which the sewing machine 1 computes information on a position on the sewing object 34. The normalized image is an image that would presumably be captured by a normalized camera. The normalized camera is a camera for which the distance from the optical center to a screen surface is a unit distance.

The optical models for the image sensor 50 and the projector 53 are the same. Therefore, the projector 53 can be considered to have the same external variables and internal variables as the image sensor 50. The internal variables for the projector 53 are stored in the internal variables storage area in the same manner as the internal variables for the image sensor 50.

External variables for the image sensor 50 and the projector 53 are stored in the external variables storage area. The external variables for the image sensor 50 are parameters that indicate the installed state (the position and the orientation) of the image sensor 50 with respect to a world coordinate system 100. Accordingly, the external variables indicate a shift of a camera coordinate system 200 with respect to the world coordinate system 100. The camera coordinate system is a three-dimensional coordinate system for the image sensor 50. The camera coordinate system 200 is schematically shown in FIG. 3. The world coordinate system 100 is a coordinate system that represents the whole of space. The world coordinate system 100 is not influenced by the center of gravity etc. of a subject. In the present embodiment, the world coordinate system 100 corresponds to the embroidery coordinate system.

An X-axial rotation vector, a Y-axial rotation vector, a Z-axial rotation vector, an X-axial translation vector, a Y-axial translation vector, and a Z-axial translation vector are stored as the external variables for the image sensor 50 in the external variables storage area. The X-axial rotation vector represents a rotation of the camera coordinate system 200 around the X-axis with respect to the world coordinate system 100. The Y-axial rotation vector represents a rotation of the camera coordinate system 200 around the Y-axis with respect to the world coordinate system 100. The Z-axial rotation vector represents a rotation of the camera coordinate system 200 around the Z-axis with respect to the world coordinate system 100. The X-axial rotation vector, the Y-axial rotation vector, and the Z-axial rotation vector are used for determining a conversion matrix that is used for converting three-dimensional coordinates in the world coordinate system 100 into three-dimensional coordinates in the camera coordinate system 200, and vice versa. The X-axial translation vector represents an X-axial shift of the camera coordinate system 200 with respect to the world coordinate system 100. The Y-axial translation vector represents a Y-axial shift of the camera coordinate system 200 with respect to the world coordinate system 100. The Z-axial translation vector represents a Z-axial shift of the camera coordinate system 200 with respect to the world coordinate system 100. The X-axial translation vector, the Y-axial translation vector, and the Z-axial translation vector are used for determining a translation vector that is used for converting three-dimensional coordinates in the world coordinate system 100 into three-dimensional coordinates in the camera coordinate system 200, and vice versa. A 3-by-3 rotation matrix that is determined based on the X-axial rotation vector, the Y-axial rotation vector, and the Z-axial rotation vector and that is used for converting the three-dimensional coordinates of the world coordinate system 100 into the three-dimensional coordinates of the camera coordinate system 200 is defined as a rotation matrix $R_c$ for the image sensor 50. A 3-by-1 translation vector that is determined based on the X-axial translation vector, the Y-axial translation vector, and the Z-axial translation vector and that is used for converting the three-dimensional coordinates of the world coordinate system 100 into the three-dimensional coordinates of the camera coordinate system 200 is defined as a translation vector $t_c$ for the image sensor 50.

The external variables for the projector 53 are parameters that indicate the installed state (the position and the orientation) of the projector 53 with respect to the world coordinate system 100. That is, the external variables for the projector 53 are parameters that indicate a shift of a projector coordinate system 300 with respect to the world coordinate system 100. The projector coordinate system 300 is a three-dimensional coordinate system for the projector 53. The projector coordinate system 300 is schematically shown in FIG. 1. The external variables for the projector 53 are stored in the external variables storage area in the same manner as the external variables for the image sensor 50. A 3-by-3 rotation matrix that is determined based on the X-axial rotation vector, the Y-axial rotation vector, and the Z-axial rotation vector for the projector 53 and that is used for converting the three-dimensional coordinates of the world coordinate system 100 into the three-dimensional coordinates of the projector coordinate system 300 is defined as a rotation matrix $R_p$. A 3-by-1 translation vector that is determined based on the X-axial translation vector, the Y-axial translation vector, and the Z-axial translation vector for the projector 53 and that is used for converting the three-dimensional coordinates of the world coordinate system 100 into the three-dimensional coordinates of the projector coordinate system 300 is defined as a translation vector $t_p$ for the projector 53.

Figure 6:
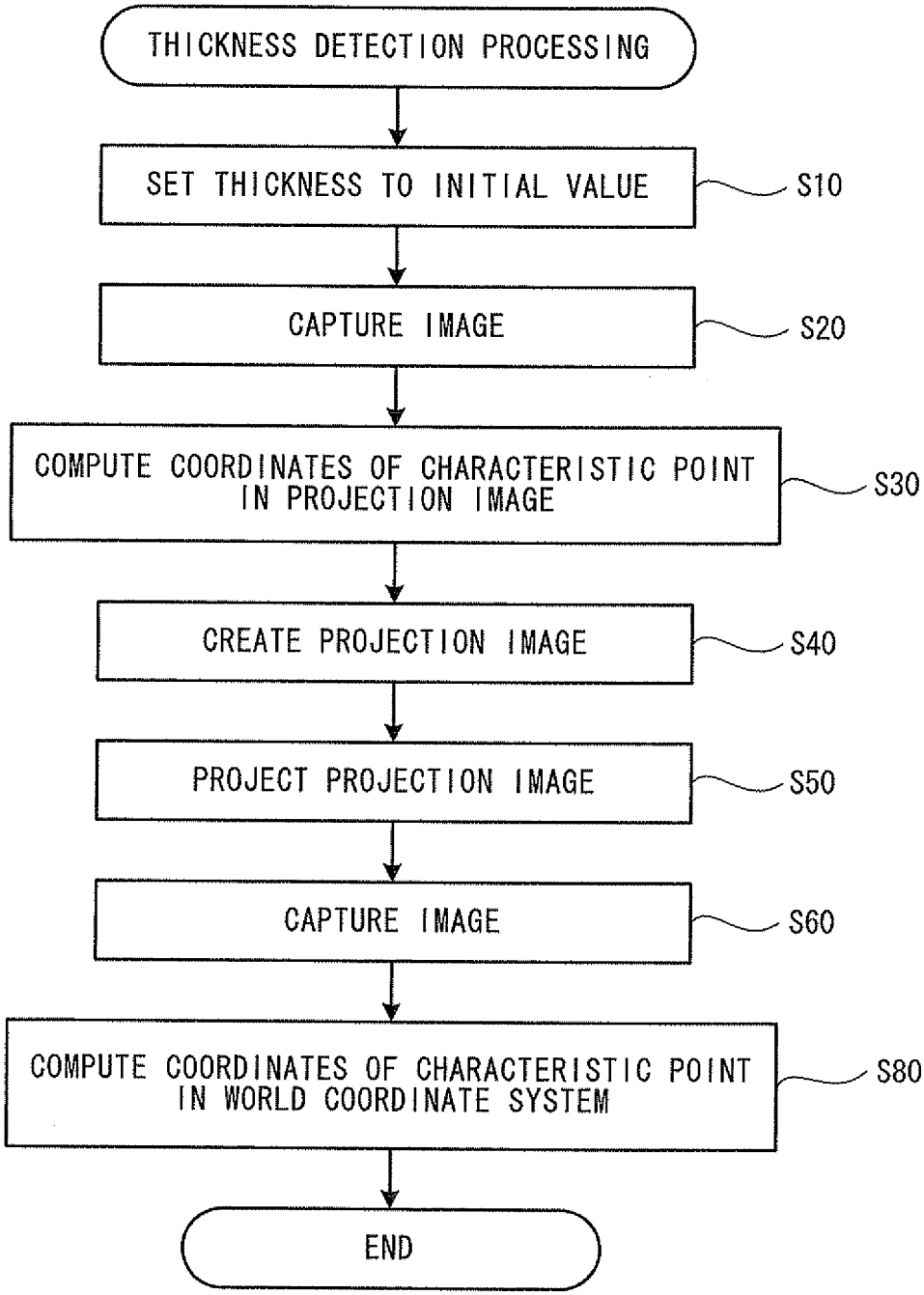
FIG. 6 is a flowchart of thickness detection processing.
Figure 7:
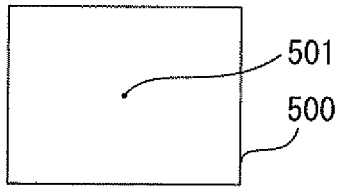
FIG. 7 is an explanatory figure of a projected image 500 that is projected in a projection area Q and includes a characteristic point 501.

Thickness detection processing that is performed by the sewing machine 1 according to the first embodiment will be explained with reference to FIGS. 6 and 7. In the thickness detection processing, the thickness of the sewing object is detected by using the image sensor 50 to capture an image of the image that is being projected onto the sewing object by the projector 53. A program for performing the thickness detection processing shown in FIG. 6 is stored in the ROM 62. The CPU 61 performs the thickness detection processing in accordance with the program that is stored in the ROM 62 in a case where the user uses a panel operation to input a command.

As shown in FIG. 6, in the thickness detection processing, first, a thickness value is set to an initial value, and the set thickness value is stored in the RAM 63 (Step S10). The initial value for the thickness differs depending on whether the side table 49 shown in FIG. 1 or the embroidery unit 30 shown in FIG. 2 is attached to the left end of the bed 2. The initial value for the thickness is a value that is set on the assumption that the thickness of the sewing object 34 is zero. In a case where the embroidery unit 30 is electrically connected to the input-output interface 66, a determination is made that the embroidery unit 30 is attached to the left end of the bed 2, and the thickness value is set to an initial value that corresponds to the embroidery unit 30. In a case where the embroidery unit 30 is not electrically connected to the input-output interface 66, a determination is made that the side table 49 is attached to the left end of the bed 2, and the thickness value is set to an initial value that corresponds to the side table 49.

An image of the sewing object 34 is captured before the projection image is projected onto the sewing object 34. The image that is created by the image capture is stored in the RAM 63 as an initial image (Step S20). The initial image that is created in the processing at Step S20 is used in processing that identifies a characteristic point in the image that is captured of the image that is being projected. Hereinafter, the image that is captured of the image that is being projected is referred to as the "captured image". Next, image coordinates of the characteristic point are computed in order for the projector 53 to project the characteristic point onto the sewing object 34, and the computed image coordinates of the characteristic point are stored in the RAM 63 (Step S30). The image coordinates that are computed in the processing at Step S30 are image coordinates for the projection image. The image coordinates are coordinates that are determined according to a position within the image. In the present embodiment, in a case where the projector 53 projects a characteristic point 501 at the center of the projection area Q, the coordinates of the characteristic point 501 are computed. In the processing at Step S30, the coordinates are computed on the assumption that the thickness of the sewing object 34 is the value that was set in the processing at Step S10.

In a case where the three-dimensional coordinates of the characteristic point in the world coordinate system 100 are defined as Mw (Xw, Yw, Zw), Xw and Yw are predetermined values. Zw is the initial value that was set in the processing at Step S10. The image coordinates in the projection image, $m'=(u', v')^T$, are computed by the procedure described below. $(u', v')^T$ is a transposed matrix for (u', v'). First, the three-dimensional coordinates Mw (Xw, Yw, Zw) of the characteristic point in the world coordinate system 100 are converted into the three-dimensional coordinates Mp (Xp, Yp, Zp) of the point in the projector coordinate system 300, based on Equation (1).

$$Mp=R_pMw+t_p \quad \text{Equation (1)}$$

In Equation (1), $R_p$ is the rotation matrix that is used for converting the three-dimensional coordinates of the world coordinate system 100, which is stored in the EEPROM 64, into the three-dimensional coordinates of the projector coordinate system 300. $t_p$ is the translation vector that is used for converting the three-dimensional coordinates of the world coordinate system 100, which is stored in the EEPROM 64, into the three-dimensional coordinates of the projector coordinate system 300.

Next, the three-dimensional coordinates of the characteristic point in the projector coordinate system 300 are converted into coordinates (x', y') in the normalized image in the projector coordinate system 300, based on Equations (2) and (3).

$$x'=Xp/Zp \quad \text{Equation (2)}$$

$$y'=Yp/Zp \quad \text{Equation (3)}$$

In addition, coordinates (x", y") are computed for a normalized projector, based on Equations (4) and (5), by taking into account the distortion of a projector lens of the projector 53. The normalized projector is a projector for which the distance from the optical center to a screen surface is a unit distance.

$$x''=x'\times(1+k_1\times r^2+k_2\times r^4) \quad \text{Equation (4)}$$

$$y''=y'\times(1+k_1\times r^2+k_2\times r^4) \quad \text{Equation (5):}$$

In Equations (4) and (5), $k_1$ and $k_2$ are respectively the first coefficient of distortion and the second coefficient of distortion for the projector 53. The equation $r^2=x'^2+y'^2$ holds true.

Next, the coordinates (x", y") are converted into the image coordinates (u', v') of the projection image, based on Equations (6) and (7).

$$u'=fx\times x''+cx \quad \text{Equation (6)}$$

$$v'=fy\times y''+cy \quad \text{Equation (7)}$$

In Equations (6) and (7), fx, cx, fy, and cy are internal variables for the projector 53. Specifically, fx is the X-axial focal length. cx is the X-axial principal point coordinate. fy is the Y-axial focal length. cy is the Y-axial principal point coordinate.

Next, the projection image is created based on the image coordinates of the characteristic point that were computed in the processing at Step S30, and the created projection image is stored in the RAM 63 (Step S40). Specifically, an image is created in which the characteristic point is placed at the position described by the image coordinates that were computed in the processing at Step S30. Next, the projecting onto the sewing object 34 of the projection image that was created in the processing at Step S40 is started (Step S50). Specifically, the light source 56 of the projector 53 is turned ON, the liquid crystal panel 57 is operated based on the projection image that was created in the processing at Step S40, and the projecting of a projected image 500 onto the sewing object 34 in the projection area Q (refer to FIG. 2) is started. For example, the characteristic point 501 is projected in the projection area Q as shown in FIG. 7.

Next, an image of the image capture area is captured by the image sensor 50. The image that is acquired by the image capture is stored in the RAM 63 as the captured image (Step S60). In the present embodiment, the image capture area for the image sensor 50 and the projection area Q for the projector 53 are congruent. However, due to the thickness of the sewing object 34, the projection area Q and the image capture area may be partially non-congruent. An image that shows the characteristic point 501 that is projected by the projector 53 is included in the captured image.

Next, the thickness of the sewing object 34 is computed, and the computed thickness is stored in the RAM 63 (Step S80). Specifically, the thickness of the sewing object 34 is computed based on the coordinates of the characteristic point 501 in the projection image that were computed in the processing at Step S30, the coordinates of the characteristic point 501 in the captured image that was acquired in the processing at Step S60, the parameters for the image sensor 50, and the parameters for the projector 53.

In the processing at Step S80, the three-dimensional coordinates of the characteristic point in the world coordinate system 100 are computed. The three-dimensional coordinates of the characteristic point in the world coordinate system 100 are computed by a method that applies a method that computes three-dimensional coordinates for a corresponding point (the characteristic point) of which images have been captured by cameras that are disposed at two different positions, by utilizing the parallax between the two camera positions. In the computation method that utilizes parallax, the three-dimensional coordinates for the corresponding point in the world coordinate system 100 are computed as hereinafter described. Under conditions in which the position of the sewing object 34 is not changed, if the image coordinates $m=(u, v)^T$ and $m'=(u', v')^T$ are known for the corresponding point of which the images have been captured by the two cameras that are disposed at the different positions, then Equations (8) and (9) can be derived.

$$sm_{av}=PMw_{av} \quad \text{Equation (8)}$$

$$s'm_{av}'=P'Mw_{av} \quad \text{Equation (9)}$$

In Equation (8), P is a camera projection matrix that yields the image coordinates $m=(u, v)^T$. In Equation (9), P' is a camera projection matrix that yields the image coordinates $m'=(u', v')^T$. The projection matrices are matrices that include the internal variables and the external variables for the cameras. $m_{av}$, $m_{av}'$, and $Mw_{av}$ are augmented vectors of m, m', and Mw, respectively. Mw represents the three-dimensional coordinates in the world coordinate system 100. The augmented vectors are derived by adding an element 1 to given vectors. For example, the augmented vector of $m=(u, v)^T$ is $m_{av}=(u, v, I)^T$. s and s' are scalars.

Equation (10) is derived from Equations (8) and (9).

$$BMw=b \quad \text{Equation (10)}$$

In Equation (10), B is a matrix with four rows and three columns. An element Bij at row i and column j of the matrix B is expressed by Equation (11). b is expressed by Equation (12).

$$(B_{11},B_{21},B_{31},B_{41},B_{12},B_{22},B_{32},B_{42},B_{13},B_{23},B_{33},B_{43})=(up_{31}-p_{11},vp_{31}-p_{21},u'p_{31}'-p_{11}',v'p_{31}'-p_{21}',up_{32}-p_{12},vp_{32}-p_{22},u'p_{32}'-p_{12}',v'p_{32}'-p_{22}',up_{33}-p_{13},vp_{33}-p_{23},u'p_{33}'-p_{13}',v'p_{33}'-p_{23}') \quad \text{Equation (11)}$$

$$b=[p_{14}-up_{34},p_{24}-vp_{34},p_{14}'-u'p_{34}',p_{24}'-v'p_{34}']^T \quad \text{Equation (12):}$$

In Equations (11) and (12), $p_{ij}$ is the element at row i and column j of the matrix P. $p_{ij}'$ is the element at row i and column j of the matrix P'. $[p_{14}-up_{34}, p_{24}-vp_{34}, p_{14}'-u'p_{34}', p_{24}'-v'p_{34}']^T$ is a transposed matrix for $[p_{14}-up_{34}, p_{24}-vp_{34}, p_{14}'-u'p_{34}', p_{24}'-v'p_{34'}]$.

Accordingly, Mw is expressed by Equation (13).

$$Mw=B^+b \quad \text{Equation (13)}$$

In Equation (13), $B^+$ expresses a pseudoinverse matrix for the matrix B.

The optical models for the image sensor 50 and the projector 53 are the same, so the case where there are two cameras is applicable. The characteristic point is defined as the corresponding point. The image coordinates of the characteristic point in the captured image are defined as $m=(u, v)^T$. The characteristic point in the captured image is specified by taking the difference between the captured image and the initial image. The image coordinates of the characteristic point in the projection image are defined as $m'=(u', v')^T$. In Equation (8), the projection matrix for the image sensor 50 is set for P. The projection matrix for the image sensor 50 is expressed by Equation (14). In the same manner, in Equation (9), the projection matrix for the projector 53 is set for P'. The projection matrix for the projector 53 is expressed by Equation (15).

$$P=A_c[R_c,t_c] \quad \text{Equation (14)}$$

$$P'=A_p[R_p,t_p] \quad \text{Equation (15)}$$

In Equation (14), $A_c$ is an internal variable for the image sensor 50. $R_c$ is a rotation matrix for converting the three-dimensional coordinates of the world coordinate system 100 into the three-dimensional coordinates of the camera coordinate system 200. $t_c$ is a translation vector for converting the three-dimensional coordinates of the world coordinate system 100 into the three-dimensional coordinates of the camera coordinate system 200. In Equation (15), $A_p$ is an internal variable for the projector 53. $R_p$ is a rotation matrix for converting the three-dimensional coordinates of the world coordinate system 100 into the three-dimensional coordinates of the projector coordinate system 300. $t_p$ is a translation vector for converting the three-dimensional coordinates of the world coordinate system 100 into the three-dimensional coordinates of the projector coordinate system 300. $A_c$, $R_c$, $t_c$, $A_p$, $R_p$, and $t_p$ are stored in the EEPROM 64. The three-dimensional coordinates Mw in the world coordinate system 100 are computed based on Equation (13), using m, m', P, and P', which are derived as described above. Of the three-dimensional coordinates Mw (Xw, Yw, Zw) of the characteristic point in the world coordinate system 100, Zw denotes the thickness of the sewing object 34. The thickness detection processing is then terminated.

According to the sewing machine 1 according to the first embodiment, the thickness of the sewing object 34 can be computed in a state in which the sewing object 34 is not being pressed. The thickness of the sewing object 34 at the desired position can be computed by the simple operation of placing the sewing object 34 within the area where the image sensor 50 can capture an image of the pattern that the projector 53 projects within the projection area Q.

Figure 8:
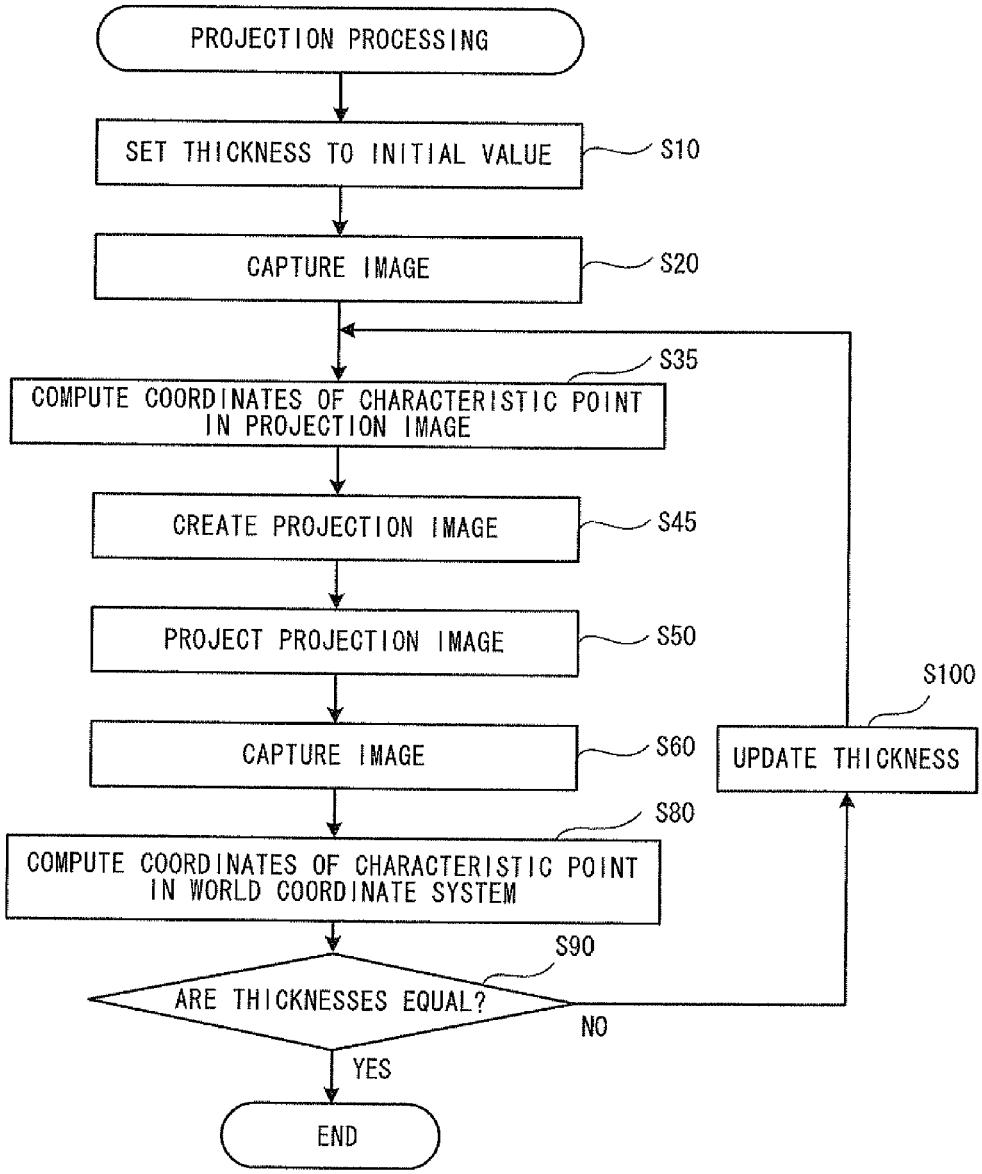
FIG. 8 is a flowchart of projection processing.
Figure 9:
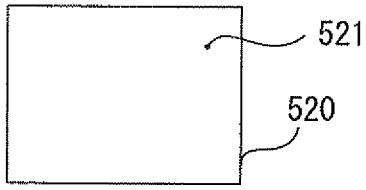
FIG. 9 is an explanatory figure of a projection image 520 for projecting a needle drop position 521 in the projection area Q.
Figure 10:
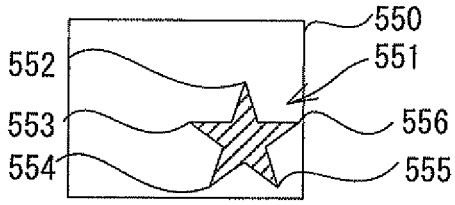
FIG. 10 is an explanatory figure of a projection image 550 for projecting in the projection area Q a pattern 551 that includes characteristic points 552 to 556.

Projection processing that is performed by the sewing machine 1 according to the second embodiment will be explained with reference to FIGS. 8 to 10. In the projection processing, a projection image for projecting onto the sewing object 34 a pattern that includes a characteristic point is projected onto the sewing object. The value for the thickness of the sewing object that is used in creating the projection image is set to one of an initial value, in the same manner as in the thickness detection processing that was described above, and a value that is computed based on the projection image and the captured image. A program for performing the projection processing shown in FIG. 8 is stored in the ROM 62 (refer to FIG. 5). The CPU 61 performs the projection processing in accordance with the program that is stored in the ROM 62 in a case where the user inputs a command by a panel operation. In the projection processing shown in FIG. 8, the same step numbers are assigned to processing that is the same as in the thickness detection processing shown in FIG. 6. For processing that is the same as the processing in the thickness detection processing, the explanation will be simplified.

As shown in FIG. 8, in the projection processing, first, processing is performed at Steps S10 and S20 that is the same as in the thickness detection processing shown in FIG. 6. Next, the coordinates of the characteristic point that is included in the pattern that will be projected are computed. The computed coordinates of the characteristic point are stored in the RAM 63 (Step S35). For the first time that the processing at Step S35 is performed, processing is performed in the same manner as the processing at Step S30 in the thickness detection processing that is shown in FIG. 6. For the second and subsequent times that the processing at Step S35 is performed, the coordinates of the characteristic point are computed using a thickness value that is computed in the processing at Step S80 and updated in the processing at Step S100, as will be described below. Next, the projection image is created for projecting the characteristic point at the coordinates that were computed in the processing at Step S35 (Step S45). For example, a projection image 520 may be created that shows a needle drop position 521, as shown in FIG. 9. For another example, a projection image 550 may be created that shows a pattern 551 that includes characteristic points 552 to 556, as shown in FIG. 10.

Next, the processing at Steps S50 to S80 is performed in the same manner as in the thickness detection processing shown in FIG. 6. Next, a determination is made as to whether the thickness that was computed in the processing at Step S80 is equal to the thickness that was set in the processing at one of Step S10 and Step S100 (Step S90). If the thickness that was computed in the processing at Step S80 is not equal to the thickness that was set in the processing at one of Step S10 and Step S100 (NO at Step S90), the thickness that was computed in the processing at Step S80 is set as the thickness value, and the set thickness is stored in the RAM 63 (Step S100). The processing then returns to Step S35. If the thickness that was computed in the processing at Step S80 is equal to the thickness that was set in the processing at one of Step S10 and Step S100 (YES at Step S90), the projection processing is terminated.

In order for the characteristic point to be projected accurately in the position that is indicated by the three-dimensional coordinates of the world coordinate system 100, it is necessary for the thickness of the sewing object 34 to be set accurately. Therefore, in the known sewing machine, the three-dimensional coordinates of the characteristic point are computed on the assumption that the thickness value is a specified value. Alternatively, in the known sewing machine, the three-dimensional coordinates of the characteristic point are computed using a device that detects the thickness of the sewing object. In the known sewing machine, if the height coordinate for the characteristic point is not set accurately, the characteristic point may not be projected accurately in the position that is indicated by the three-dimensional coordinates of the world coordinate system 100. The sewing machine 1 according to the second embodiment creates the projection image based on the thickness of the sewing object 34 that is computed based on the projection image and the captured image. The sewing machine 1 is therefore able to accurately project a pattern of a specified size in a specified position on the sewing object 34. In a case where a projection image is projected that includes a pattern that indicates the needle drop position, the user is able to know the needle drop position accurately based on the projected image. It is therefore possible to prevent a stitch from being formed in a position where the user does not intend to form the stitch. In a case where a projection image is projected that includes an embroidery pattern that is to be sewn, the user is able to accurately know the position where the embroidery pattern is to be sewn, based on the projected image, before the sewing is performed. It is therefore possible to prevent the embroidery pattern to be sewn in a position where the user does not intend to sew the embroidery pattern.

The sewing machine 1 of the present disclosure is not limited to the embodiments that have been described above, an various types of modifications can be made within the scope of the claims of the present disclosure. For example, the modifications described in (A) to (D) below may be made as desired.

(A) The configuration of the sewing machine 1 may be modified as desired. For example, the sewing machine 1 may be one of a multi-needle sewing machine and an industrial sewing machine. For example, the sewing machine 1 may be modified as described in (A-1) to (A-3) below.

(A-1) The image sensor 50 that the sewing machine 1 includes may be one of a CCD camera and another image capture element. The mounting position of the image sensor 50 can be modified as desired, as long as the image sensor 50 is able to acquire an image of an area on the bed 2.

(A-2) The projector 53 which the sewing machine 1 includes may be any device that is capable of projecting an image onto the bed 2. The position in which the projector 53 is mounted and the projection area of the projector 53 can be modified as desired. In the present embodiment, the projection area Q of the projector 53 is congruent with the image capture area of the image sensor 50. However, the projection area Q of the projector 53 and the image capture area of the image sensor 50 may be partially non-congruent areas. In that case, the characteristic point may be projected in an area where the projection area Q of the projector 53 and the image capture area of the image sensor 50 overlap.

(A-3) The embroidery unit 30 may be attached to the sewing machine 1. However, it is acceptable for the embroidery unit 30 not to be attachable to the sewing machine 1. Different initial values are set for the thickness value in a case where the embroidery unit 30 is attached to the sewing machine 1 and in a case where the side table 49 is attached to the sewing machine 1. However, it is acceptable for the initial values that are set not to be different. The same value may be set for the thickness value in a case where the embroidery unit 30 is attached to the sewing machine 1 and in a case where the side table 49 is attached to the sewing machine 1, as long as the position of the surface of the sewing object is the same.

(B) The camera coordinate system, the projector coordinate system, and the world coordinate system may be associated with one another by parameters that are stored in the sewing machine 1. The methods for defining the camera coordinate system, the projector coordinate system, and the world coordinate system may be modified as desired. For example, the world coordinate system may be defined such that the upper portion of the up-down direction of the sewing machine 1 is defined as positive on the Z axis.

(C) Any given pattern may be projected in the thickness detection processing and the projection processing. For example, one of an embroidery pattern and a stitch that the sewing machine 1 is to sew may be projected in the position where the one of the embroidery pattern and the stitch is to be sewn. In accordance with the image that is projected onto the sewing object, the user is easily able to know the position where the one of the embroidery pattern and the stitch will be formed. For example, any pattern that indicates a specified position, such as a cross-shaped mark that indicates the needle drop position, may be projected.

(D) The processing that is performed in the thickness detection processing and the projection processing may be modified as desired. For example, the method for computing the three-dimensional coordinates of the characteristic point in the world coordinate system 100 may be modified as desired. The three-dimensional coordinates of the characteristic point in the world coordinate system 100 may be computed based on the assumption that the three-dimensional coordinates of the characteristic point in the world coordinate system 100 that are specified based on the projection image are equal to the three-dimensional coordinates of the characteristic point in the world coordinate system 100 that are specified based on the captured image, with the thickness of the sewing object defined as an unknown value. In a case where a plurality of the characteristic points are included in the projection image, the thickness of the sewing object may be computed for one of the characteristic points and may also be computed for the plurality of the characteristic points. In a case where the thickness of the sewing object can be assumed to be uniform, a representative value for the thickness may be computed based on a plurality of thicknesses that are computed for the plurality of the characteristic points. The representative value may be one of a mean value and a mode value, for example. In a case where the thickness of the sewing object can be assumed not to be uniform, the projection image may be created based on each of the plurality of the thicknesses that are computed for the plurality of the characteristic points.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine, comprising:

a creating portion that creates a projection image, the projection image including a characteristic point and being configured to be projected onto a sewing object;

a projecting portion that is configured to project onto the sewing object the projection image created by the creating portion;

an image capture portion that is mounted in a position being different from a position of the projecting portion and that is configured to create a captured image by image capture of the characteristic point projected by the projecting portion; and a computing portion that is configured to compute a thickness of the sewing object based on: (i) the projection image created by the creating portion, (ii) the captured image created by the image capture portion, (iii) an internal variable and an external variable for the projecting portion, and (iv) an internal variable and an external variable for the image capture portion.

2. The sewing machine according to claim 1, wherein the computing portion computes the thickness of the sewing object based on a result of a comparison of coordinates of the characteristic point included in the projection image and coordinates of the characteristic point included in the captured image, and the creating portion, in a case where the thickness of the sewing object has been computed by the computing portion, creates the projection image based on the thickness that has been computed.

3. A non-transitory computer-readable medium storing a control program executable on a sewing machine, the sewing machine comprising a projection portion and an image capture portion, the projection portion being configured to project a projection image onto a sewing object, the image capture portion being mounted in a position being different from a position of the projection portion and being configured to create a captured image by image capture, the program comprising instructions that cause a computer of the sewing machine to perform steps of:

creating a projection image, the projection image including a characteristic point and being configured to be projected onto a sewing object;

acquiring a captured image, the captured image being created by image capture of the characteristic point projected on the sewing object; and computing a thickness of the sewing object based on: (i) the projection image, (ii) the captured image, (iii) an internal variable and an external variable for the projection portion, and (iv) an internal variable and an external variable for the image capture portion.

4. The non-transitory computer-readable medium according to claim 3, wherein the thickness of the sewing object is computed based on a result of a comparison of coordinates of the characteristic point included in the projection image and coordinates of the characteristic point included in the captured image, and in a case where the thickness of the sewing object has been computed, the projection image is created based on the thickness that has been computed.

* * * * *